US010249165B1

(12) United States Patent
Doetzel

(10) Patent No.: US 10,249,165 B1
(45) Date of Patent: Apr. 2, 2019

(54) CHILD SAFETY BOUNDARY ALARM SYSTEM

(71) Applicant: Chad Doetzel, Nuevo Vallarta Nayarit (MX)

(72) Inventor: Chad Doetzel, Nuevo Vallarta Nayarit (MX)

( * ) Notice: Subject to any disclaimer, the term of this patent is extended or adjusted under 35 U.S.C. 154(b) by 0 days.

(21) Appl. No.: 15/874,364

(22) Filed: Jan. 18, 2018

Related U.S. Application Data

(60) Provisional application No. 62/448,054, filed on Jan. 19, 2017.

(51) Int. Cl.
*G08B 23/00* (2006.01)
*G08B 21/02* (2006.01)

(52) U.S. Cl.
CPC ..... *G08B 21/0261* (2013.01); *G08B 21/0236* (2013.01); *G08B 21/0288* (2013.01)

(58) Field of Classification Search
CPC .. G08B 21/082; G08B 21/088; G08B 21/086; G08B 21/023; G08B 21/084; G08B 13/122; G08B 13/183; G08B 21/0275; A01K 15/023; G01S 13/003; G01S 13/122
See application file for complete search history.

(56) References Cited

U.S. PATENT DOCUMENTS 3,732,556 A * 5/1973 Caprillo ..... G08B 21/082 200/61.04
5,272,466 A * 12/1993 Venczel ..... H01Q 7/005 340/573.3
5,486,814 A * 1/1996 Quinones ..... G08B 21/088 340/569
5,548,275 A * 8/1996 Shambayati ..... G08B 13/10 340/544
5,638,048 A * 6/1997 Curry ..... G01S 13/56 340/522
6,064,309 A * 5/2000 Sellers ..... G08B 21/086 340/539.1
6,130,615 A * 10/2000 Poteet ..... G08B 21/086 340/539.1
6,157,303 A 12/2000 Bodie et al.
6,259,365 B1 * 7/2001 Hagar ..... G08B 13/184 340/541

(Continued)

FOREIGN PATENT DOCUMENTS

WO WO2007077558 7/2007
WO WO2010040467 4/2010

(Continued)

*Primary Examiner* — Hoi C Lau
(74) *Attorney, Agent, or Firm* — Goldstein Law Offices, P.C.

(57) ABSTRACT

A child safety boundary alarm system, for warning caregivers of a dangerous situation when a child passes a boundary near a hazard such as a swimming pool. The system includes a base unit, an auxiliary unit, and a bracelet worn by the child. The caregivers have portable electronic devices. The base unit and auxiliary unit have annunciators and the system is connected to a computer network. When the base unit determines that the child has crossed the boundary, audible and visual warnings are generated by the annunciators and notifications are provided to the electronic devices of the caregivers using the computer network.

3 Claims, 8 Drawing Sheets

(56) References Cited

U.S. PATENT DOCUMENTS 6,476,721 B1 * 11/2002 Diebold ..... G08B 21/088 340/566
6,583,724 B1 * 6/2003 Rodriguez ..... G08B 21/082 340/522
6,720,881 B1 * 4/2004 Halliday ..... A01K 15/023 119/721
6,731,210 B2 * 5/2004 Swanson ..... G08B 13/122 340/561
7,218,235 B1 * 5/2007 Rainey ..... G08B 21/086 340/521
7,508,304 B2 * 3/2009 Swanson ..... G08B 13/122 340/541
8,144,020 B2 * 3/2012 Snyder ..... G08B 21/088 340/529
8,232,878 B2 * 7/2012 van Doorn ..... G01S 13/003 340/539.1
9,183,721 B2 11/2015 Mock et al.
9,666,054 B2 * 5/2017 Matko ..... H05K 999/99
9,911,301 B1 * 3/2018 Foley ..... G08B 21/0275
9,928,719 B1 * 3/2018 Webb ..... G08B 21/084
2003/0020610 A1 * 1/2003 Swanson ..... G08B 13/122 340/566
2004/0239507 A1 * 12/2004 Neary ..... A01K 15/023 340/573.4
2006/0226994 A1 * 10/2006 So ..... A01K 15/023 340/573.3
2007/0008123 A1 * 1/2007 Swanson ..... G08B 13/122 340/541
2007/0132578 A1 * 6/2007 Powell ..... G08B 21/023 340/539.26
2008/0007407 A1 * 1/2008 de Elia ..... G08B 21/0261 340/572.1
2008/0018464 A1 * 1/2008 van Doorn ..... G01S 13/003 340/553
2008/0074262 A1 * 3/2008 Paulkovich ..... G06Q 10/087 340/572.1
2008/0084317 A1 * 4/2008 Gakhar ..... G08B 21/086 340/573.4
2008/0174441 A1 * 7/2008 Durand ..... G08B 21/084 340/573.6
2008/0266118 A1 * 10/2008 Pierson ..... A61B 5/0205 340/573.6
2009/0027211 A1 * 1/2009 Cutler ..... G08B 21/088 340/573.6
2009/0126096 A1 * 5/2009 Bocos ..... E04H 4/065 4/496
2009/0295566 A1 * 12/2009 Weintraub ..... G08B 21/088 340/539.11
2009/0303055 A1 * 12/2009 Anderson ..... G08B 21/086 340/573.6
2010/0117821 A1 * 5/2010 Cruz ..... G08B 21/0275 340/539.1
2011/0084833 A1 * 4/2011 van Doorn ..... G01S 13/003 340/539.16
2011/0273291 A1 * 11/2011 Adams ..... G08B 13/183 340/552
2016/0012700 A1 * 1/2016 Matko ..... H05K 999/99 340/573.6

FOREIGN PATENT DOCUMENTS

WO WO2016007658 1/2016
WO WO2016029259 3/2016

* cited by examiner

CHILD SAFETY BOUNDARY ALARM SYSTEM

CROSS REFERENCES AND RELATED SUBJECT MATTER

This application is a non-provisional filing of provisional patent application Ser. No. 62/448,054, which was filed in the United States Patent Office on Jan. 19, 2017, from which priority is claimed and that is incorporated by reference herein in its entirety.

TECHNICAL FIELD

The present disclosure relates generally to a child safety alarm system. More particularly, the present disclosure relates to an alarm system for providing danger warnings and notifications when a child crosses a boundary delimiting a region considered potentially dangerous to the child.

BACKGROUND

It is a primary concern of parents to keep their children safe. Parents spend a great deal of their time and attention making certain that their children do not encounter dangerous situations. Especially when parenting young children, simply watching them can be a full time job.

Toddlers are especially prone to hazards. They enjoy their mobility and spend much of their time exploring their environment. Unfortunately, they do not yet know how to identify and avoid hazards that might injure or even kill them.

Backyard swimming pools are among the most deadly of hazards for small children. Each year, thousands of children die from accidental drowning in their own back yard. Most commonly, these deaths occur when the child wandered unattended into the backyard and ventured too close to the pool. Most unfortunate, is that there was usually time to stop the tragedy. Surveillance video often shows the child spending seconds or even minutes in the done of danger before they fall in. And even once they fall in, there is often several minutes where they could be saved. The problem is that most often the parent doesn't know the child is in danger until it is too late. They believe the child is still in the house, perhaps even that the child is sleeping in their bed, all while tragedy is in the making.

Other systems have been proposed and developed that seek to warn a parent when a child is missing, or when the child has fallen into a swimming pool. While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a device that effectively warns a caregiver when a child enters a hazardous region. Accordingly, the present disclosure describes a system that provides an alert that may include audible and visual warnings, as well as notifications to electronic devices external to the system.

It is another aspect of an example embodiment in the present disclosure to trigger an alert condition before the child is harmed. Accordingly, a boundary is created that is separated from the hazard by a margin, such that the alert condition is generated immediately when the child crosses the boundary, and the attention of the caregivers is gained before the child actually reaches the hazard.

It is yet another aspect of an example embodiment in the present disclosure to ensure that caregivers are immediately notified of the dangerous situation. Accordingly the system employs at least one auxiliary unit, located within the dwelling, to provide audible and visual warnings therein. The system is connected to a computer network such as the Internet, so that notifications are immediately provided to the portable electronic devices of the caregivers, such as smartphones, tablets, and PDAs.

Accordingly, the present disclosure describes a child safety boundary alarm system, for warning caregivers of a dangerous situation when a child passes a boundary near a hazard such as a swimming pool. The system includes a base unit, an auxiliary unit, and a bracelet worn by the child. The caregivers have portable electronic devices. The base unit and auxiliary unit have annunciators and the system is connected to a computer network. When the base unit determines that the child has crossed the boundary, audible and visual warnings are generated by the annunciators and notifications are provided to the electronic devices of the caregivers using the computer network.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
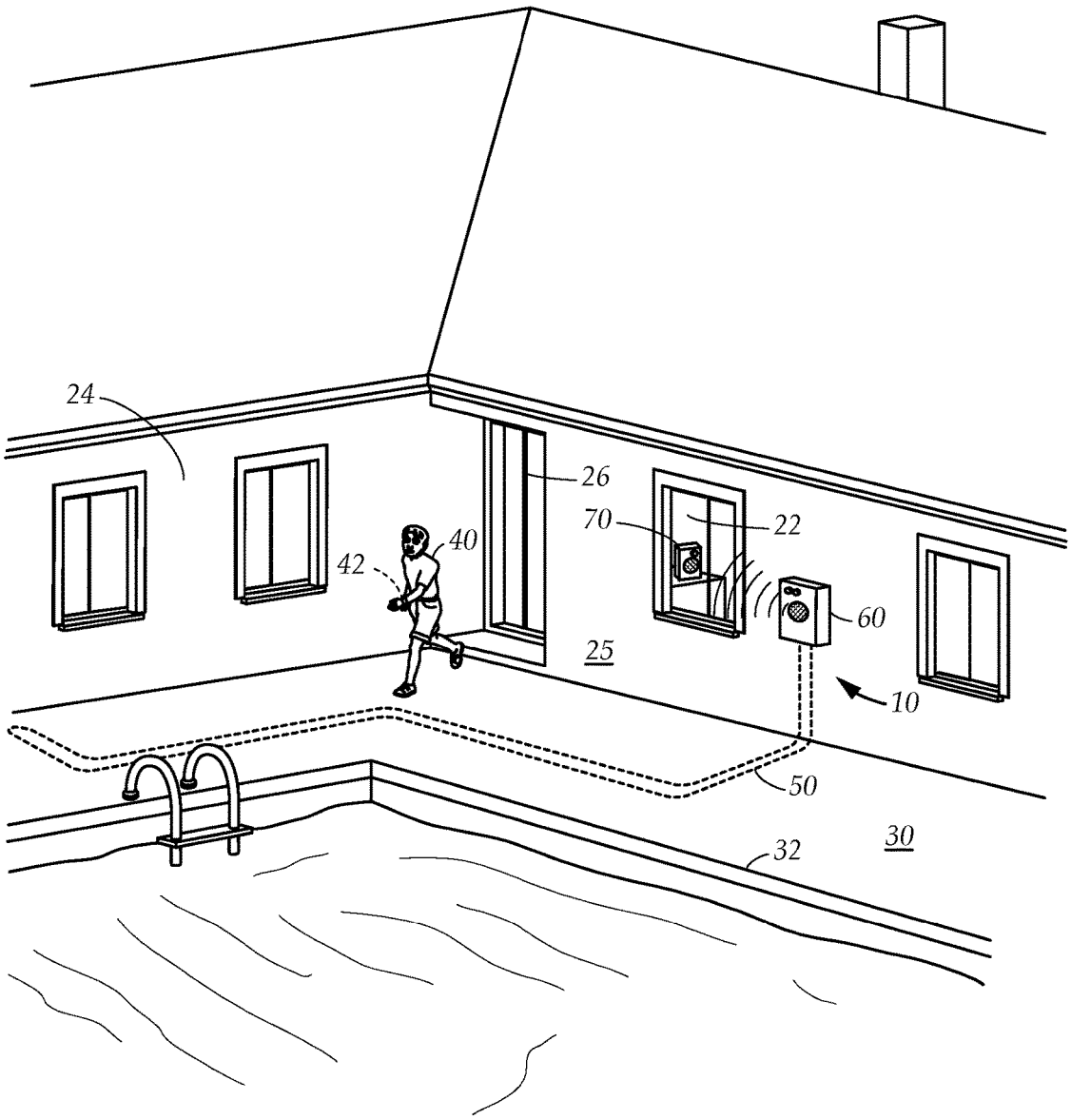
FIG. 1 is diagrammatic perspective view, illustrating the alarm system installed in and around a dwelling.

FIG. 1 illustrates an alarm system 10, installed in conjunction with a dwelling 20. The dwelling 20 includes an interior space 22, an exterior space 24, an outside wall 25, and a door 26 between the interior space 22 and exterior space 24 on or near the outside wall 25. The exterior space 24 includes a ground surface 30, and a swimming pool 32. The system includes a base unit 60 on the outside wall 25 and a sensor wire 50 connected to the base unit. An auxiliary unit 70 is located inside the dwelling 20. A child 40 is present on the ground surface 30 near the swimming pool 32 and is wearing a bracelet 42. For the purposes of the present discussion, the swimming pool 32 represents a hazard. In accordance with principles of the present disclosure, a boundary is created around or adjacent to the hazard using the sensor wire 50, and wherein crossing the boundary by the child 40 wearing the bracelet 42 will result in an alarm being triggered such that notifications are appropriately made to caregivers so as to prevent the child 40 from being harmed by the hazard.

In the example embodiment illustrated in FIG. 1, the sensor wire 50 extends along the ground surface 30 and creates the boundary such that the child passing over the sensor wire 50 will trigger an audible alarm from a base unit 60. Note that in this example embodiment, the sensor wire 50 is connected directly to the base unit 60, and creates a closed loop/closed circuit therewith.

With the configuration of FIG. 1, the sensor wire 50 may be positioned so as to create a boundary relative to the dwelling 20 and the door 26. Accordingly, when the child exits from the interior space 22 through the door 26, and either gets too close to the swimming pool 32 or ventures too far from the door 26, the boundary created by the sensor wire 50 will be crossed by the child, an alert condition is detected, and thus the alarm will be triggered and appropriate warnings generated.

Figure 3:
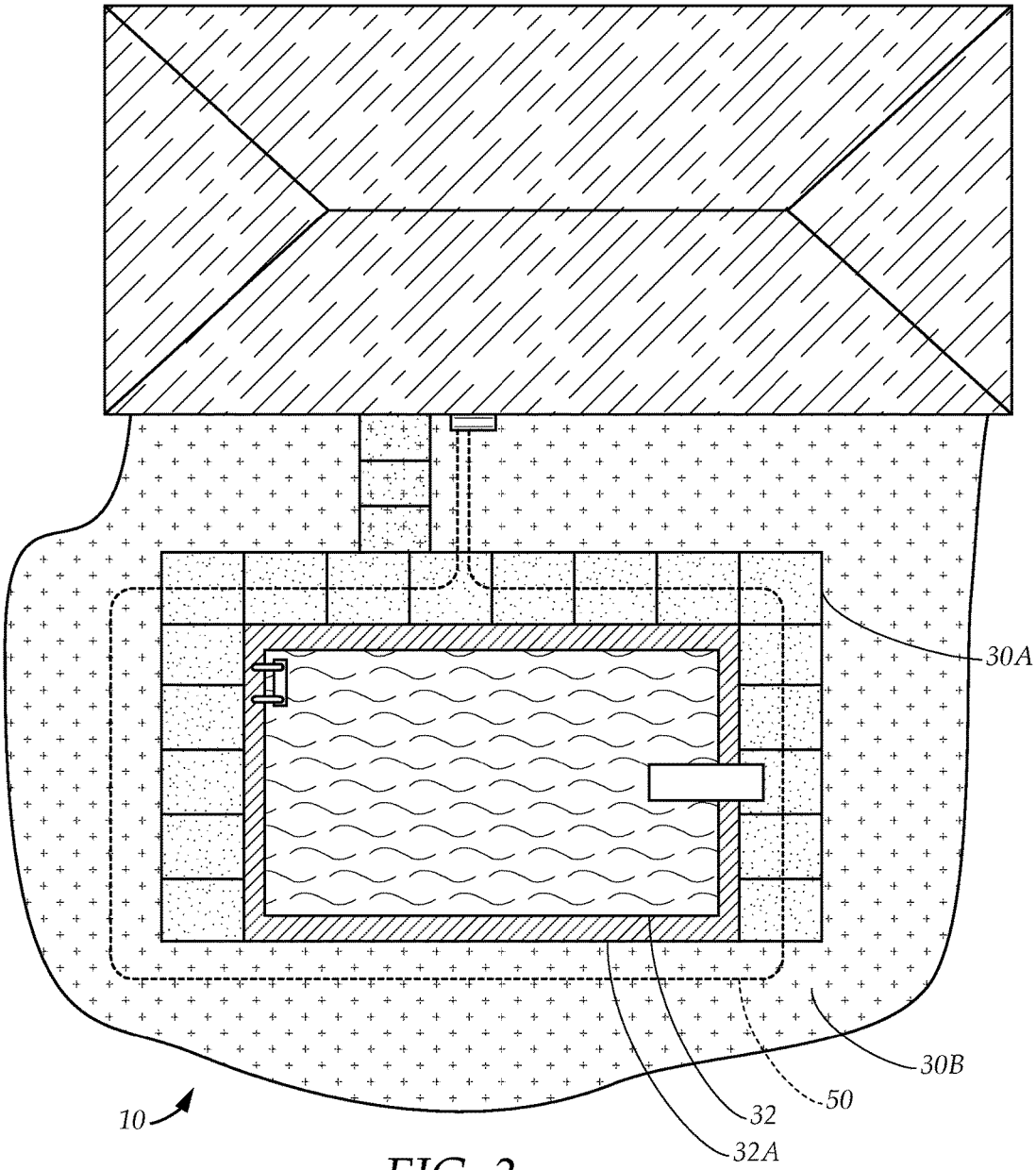
FIG. 3 is a top plan view, illustrating a sensor wire installed around a swimming pool, creating a boundary therearound.

FIG. 3 provides a configuration of the alarm system 10 as described in FIG. 1, except where the boundary is created in relation to the swimming pool 32. In particular, the swimming pool 32 has an outer edge 32A. The sensor wire 50 extends fully around the outer edge 32A at a margin distance therefrom. The margin distance defines a hazardous region and creates a range within which the alert condition is triggered but the child has not yet reached the hazard and therefore has not yet been harmed. Note that the sensor wire 50 extending along the surface means that the sensor wire 50 extends parallel to the surface. The sensor wire 50 may extend parallel to the surface either by resting on top of the surface or by being buried a short distance beneath the surface. Accordingly, in the example of FIG. 3, the swimming pool 32 is surrounded by both patio surface 30A and natural ground surface 30B. In such an installation the sensor wire may be both buried beneath the surface and extend on top of the surface. For example, the sensor wire 50 may buried when its path extends along the natural ground surface 30B. At the patio surface 30B, however, the sensor wire 50 may extend on top of the patio surface. In this regard, the sensor wire 50 may be configured as relative low profile (thin) wire, or even flattened into a broad surface and embodied in a tape-like configuration so that it creates a sensory boundary without creating a tripping hazard. The ability to install the sensor wire on the patio surface 30B is especially helpful if the patio is already existing at the time the alarm system 10 is installed.

Figure 5:
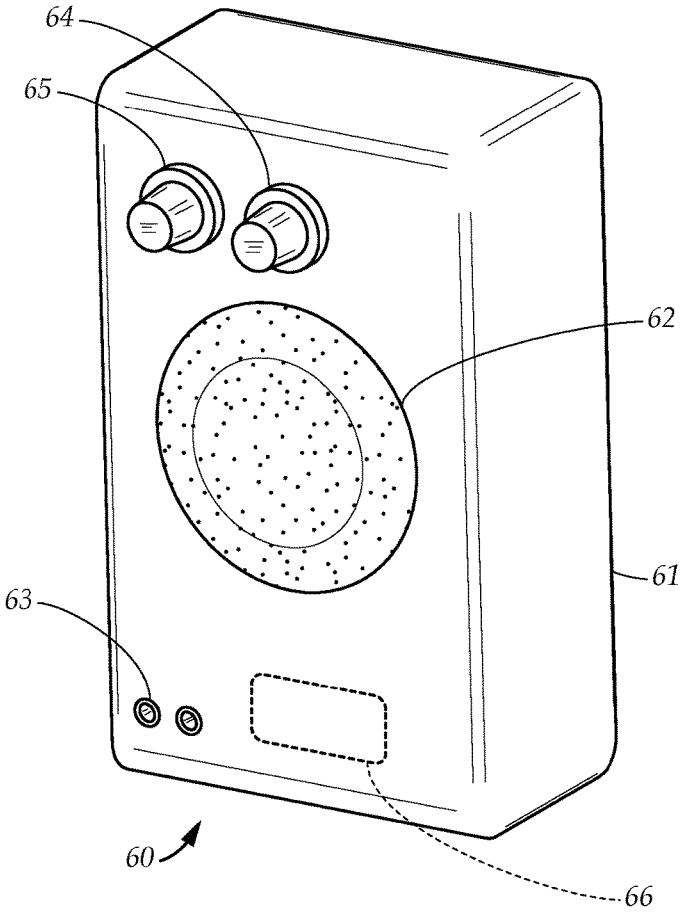
FIG. 5 is a diagrammatic perspective view, illustrating a base unit of the alarm system.

Referring to FIG. 5, the base unit 60 has a housing 61 that may be configured to be readily mountable on a vertical surface. The base unit 60 includes an alarm annunciator 62 capable of generating a loud audible warning when the alert condition is detected. The alarm annunciator 62 may also embody a light or strobe for creating a highly visible flashing light warning. The base unit has sensor wire inputs 63 that facilitate connection to the sensor wire 50 shown in FIGS. 1 and 3. In addition, the base unit 60 may include a volume control 64 for suitably adjusting the audible warning, and a sensitivity control 65 that can be adjusted to avoid false triggering by adjusting responsiveness of the base unit to proximity of the bracelet and sensor wire 50. The base unit 60 also includes a wireless transmitter 66, for generating an alert signal when the alert condition is detected and propagating the alert signal to other devices. The wireless unit may use any suitable communication protocol, including digital signals using WiFi or Bluetooth, and analog RF signals.

Figure 7:
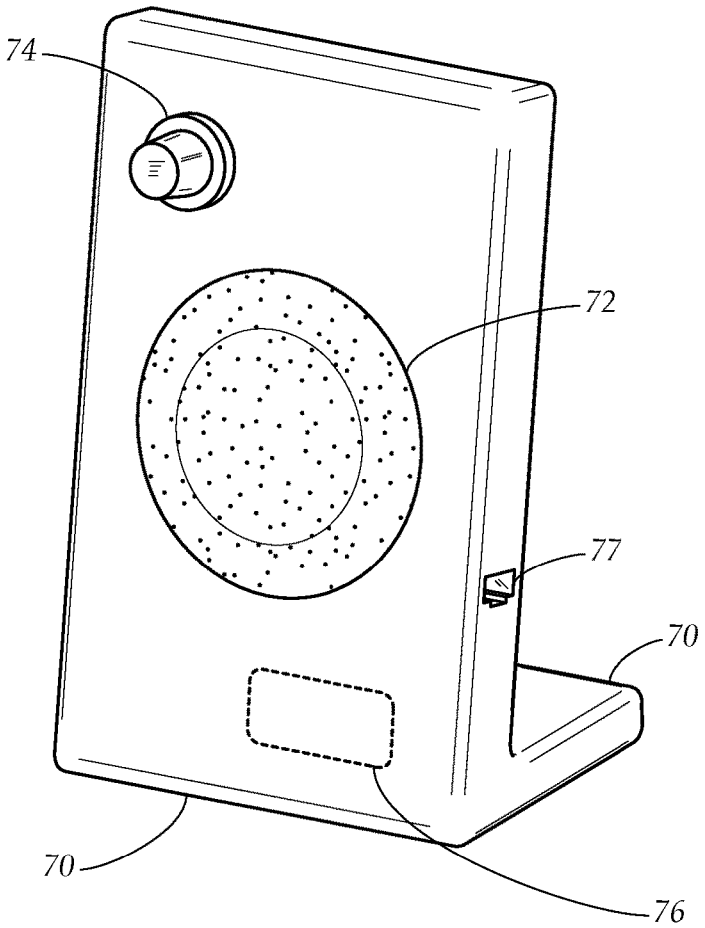
FIG. 7 is a diagrammatic perspective view, illustrating an auxiliary unit of the alarm system.

FIG. 7 shows the auxiliary unit 70. The auxiliary unit 70 is contained in a housing 71 that may be configured to rest upon a horizontal surface as shown. The auxiliary unit 70 is configured to respond to the alert condition when detected by the base unit 60 shown in FIG. 5. Accordingly, the auxiliary unit 70 has a wireless transceiver 76 that allows the auxiliary unit 70 to receive the alert signal and to repeat the alert signal to other similar auxiliary units 70. Thus, the auxiliary unit 70 has an auxiliary annunciator 72 for generating an audible and/or visual warning that may be adjusted with a volume control 74. At least one auxiliary unit 70 is located within the dwelling, and preferably several auxiliary units 70 are employed to ensure that the warning can be heard and/or seen throughout the dwelling. The auxiliary unit 70 is preferably configured for connecting to a computer network such as the Internet for further propagating the warning by all suitable means, including but not limited to text messaging, SMS, MMS, and email notifications. This connection to the computer network may be made wirelessly, such as using WiFi, or through a wired connection using a network port 77 provided on the housing 71.

Figure 8:
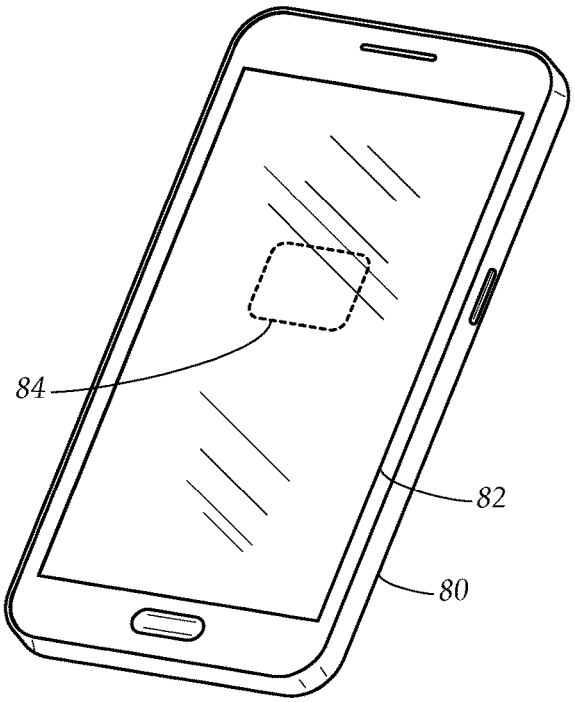
FIG. 8 is a diagrammatic perspective view, illustrating a smartphone receiving an alert notification from the alarm system.

Once the alert condition is provided to the computer network, it may be communicated to the electronic devices of caregivers and others that may respond to the detected dangerous condition. When appropriate, emergency personnel can be contacted though email and text messaging, and even with an audio phone call. Accordingly FIG. 8 illustrates a portable electronic device 80 such as a smartphone, tablet, PDA, or the like. The electronic device 80 has a touchscreen display 82, has an operating system, and is capable of communication with the computer network and receiving alerts therefrom. The electronic device 80 has received a warning notification 84 on the touchscreen display, generated in response to the alert condition. The warning notification 84 may be text based, and may also be a highly visual flashing warning. The warning notification 84 may further include an audible component, such as a unique sound that unmistakably indicates the dangerous condition. To provide such functionality, the electronic device 80 may be running application software designed specifically to work with the alarm system and to facilitate customized warning configurations not necessarily provided by the operating system of the electronic device. In addition, the alert signal generated by the alarm system may be configured within standardized messaging and alert protocols to create notifications on the electronic device by using features of its operating system and without requiring customized application software. In this regard, the alarm system may be provided with a configuration interface, so that it can be configured by one of the electronic devices to set alert preferences, notification telephone numbers, and the like.

Figure 4:
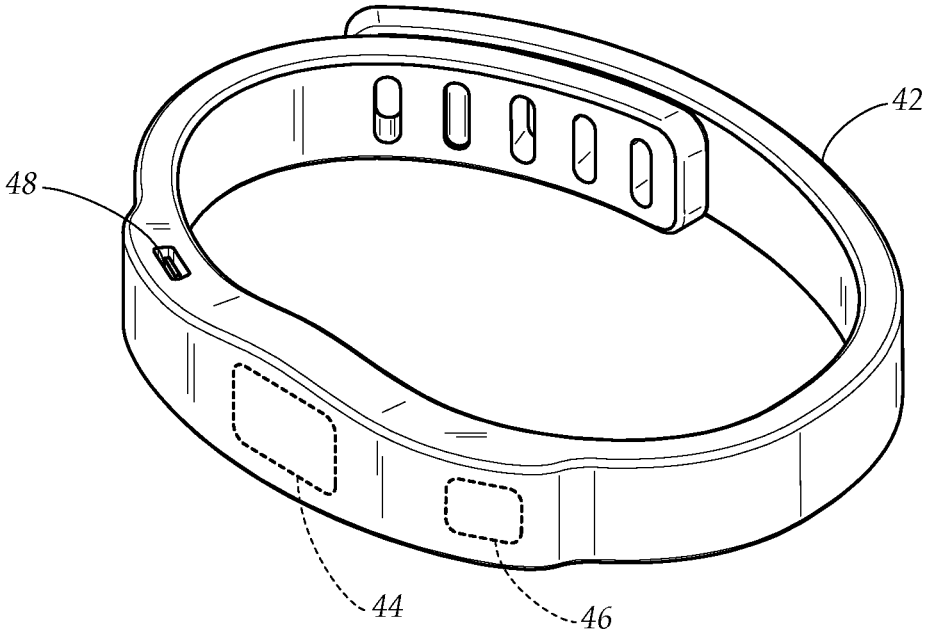
FIG. 4 is a diagrammatic perspective view, illustrating a wristband for use as a component in the alarm system of the present disclosure.

FIG. 4 illustrates an example of the bracelet 42. According to the embodiment previously described, the bracelet 42 is configured to interact with the sensor wire 50 (shown in FIGS. 1 and 3) so that the alarm system detects the alert condition when the bracelet 42 passes over the sensor wire 50. This result may be accomplished in a variety of ways, including by transmitting a repeating pattern on the sensor wire 50 that is detected by the bracelet 42, and transmitting a repeating pattern on the bracelet 42 that is detected by the sensor wire 50. Accordingly, the bracelet 42 may have a sensor transceiver 44 that is adapted to interact with the sensor wire 50 to accomplish this functionality. In the case that the sensor transceiver 44 detects the sensor wire 50, the bracelet 42 may have a local transmitter 46 for sending a bracelet alert to the base unit 60 when the bracelet 42 passes over the sensor wire (FIGS. 1 and 3). A charging port 48 may be provided on the bracelet for recharging an internal battery therein and may also be used for configuring the system and/or pairing with the base unit.

Figure 2:
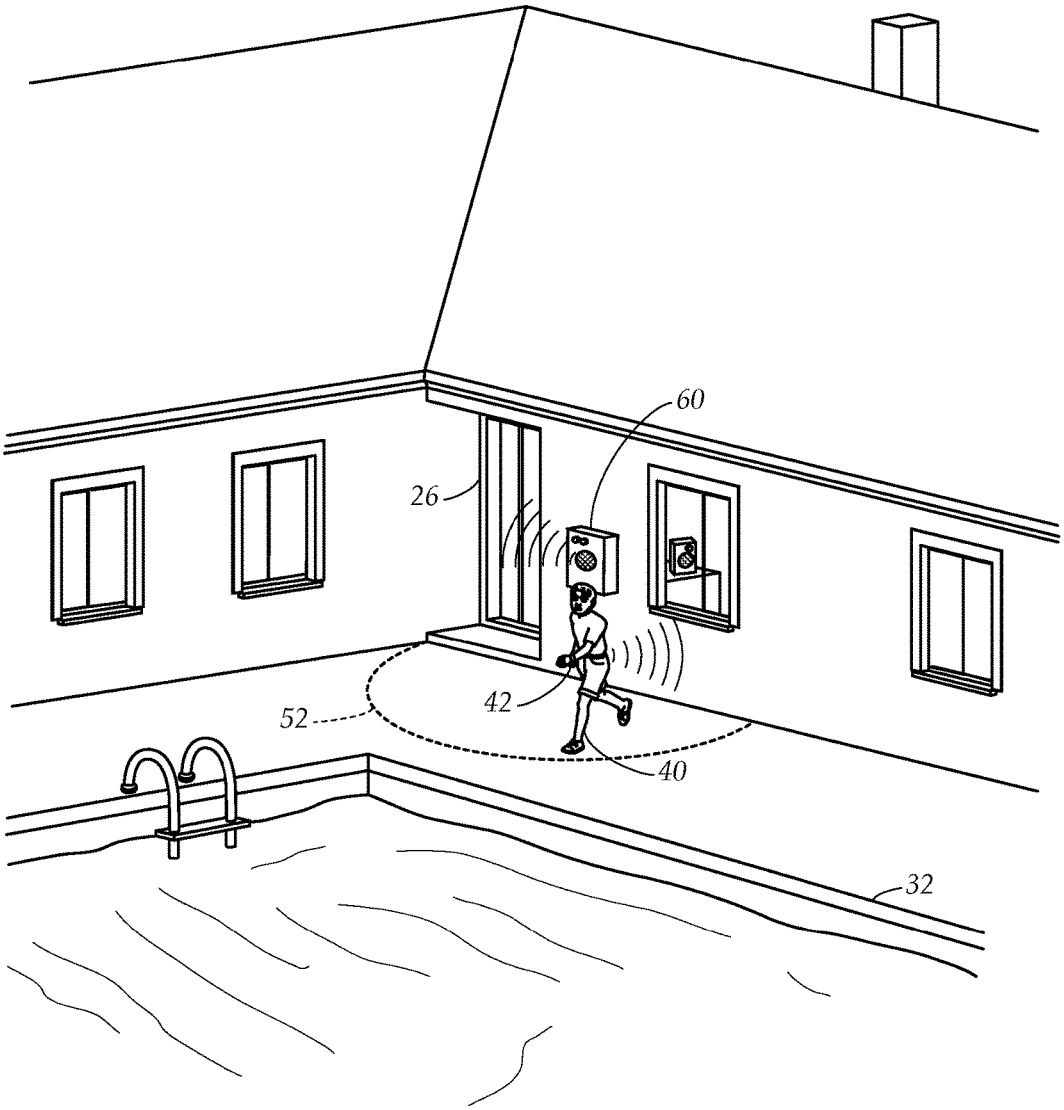
FIG. 2 is a diagrammatic perspective view, illustrating another embodiment of the alarm system installed in and around a dwelling.
Figure 6:
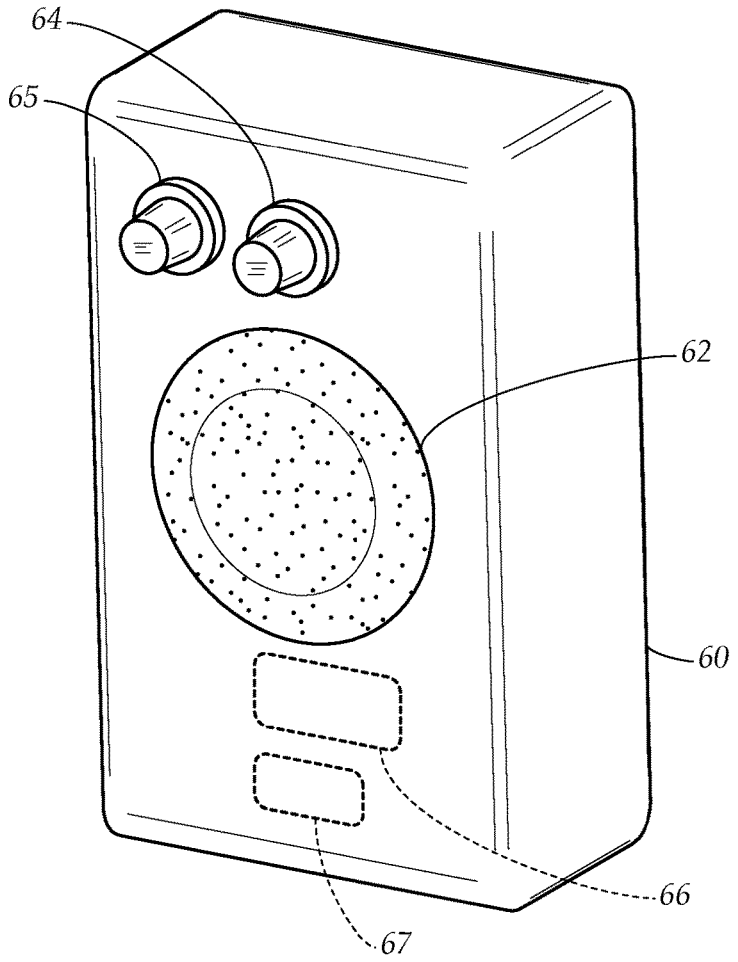
FIG. 6 is a diagrammatic perspective view, illustrating another embodiment of the base unit.

FIG. 2 and FIG. 6 provide an additional embodiment of the alarm system 10. In this embodiment, the base unit 60 directly detects proximity of the bracelet 42 with a local transceiver 67 and its communication or lack of communication with the bracelet 42, and appropriately generates the alert condition using the alarm annunciator 62 and wireless transmitter 66. Accordingly, the base unit does not have sensor wire inputs because no sensor wire is needed or employed by this embodiment. The alarm system can be configured to create a virtual boundary 52 centered on the base unit 60. Accordingly, depending on the arrangement between the door 26 and the swimming pool 32, the base unit 60 might be positioned immediately alongside the door 26 so that the child 40 will always pass in a region between the base unit 60 and virtual boundary 52. The system can be programmed in a variety of ways, as appropriate, to detect the presence or absence of a signal to/from the bracelet 42, to best determine that a dangerous condition exists and generate the alert condition in response thereto.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a child safety boundary alarm system. The disclosure is illustrated by example in the drawing figures, and throughout the written description. It should be understood that numerous variations are possible, while adhering to the inventive concept. Such variations are contemplated as being a part of the present disclosure.

What is claimed is:

1. A child safety boundary alarm, for protecting a child, comprising:

a dwelling having a computer network, an interior space, an outside wall, an exterior space including a ground surface and a swimming pool having an outer edge, a base unit mounted on the exterior wall, having a housing having a sensitivity control and a pair of sensor wire inputs and having an alarm annunciator for generating a loud audible warning and also creates a highly visible flashing light warning, the base unit also having a wireless transmitter;

a sensor wire extending along the ground surface between the swimming pool and the exterior wall, the sensor wire extending fully around the swimming pool at a margin distance from the outer edge, the sensor wire connected to the sensor wire inputs on the base unit and creating a closed loop between the sensor wire inputs;

a bracelet, adapted to be worn by a child, the bracelet having a sensor transceiver so that when the bracelet travels over the sensor wire an alert condition is detected and an alert signal is generated by the base unit and the loud audible warning is generated by the alarm annunciator, wherein the sensitivity control on the base unit adjusts responsiveness of the base unit to proximity of the sensor wire to the bracelet;

an auxiliary unit located within the interior space of the dwelling and connected to the computer network, when the alert is generated by the base unit an audible alarm is provided by the auxiliary unit, the base unit generating the alert signal to the auxiliary unit when the alert condition is detected; and a portable electronic device having a touchscreen display and connected to the computer network, wherein the auxiliary unit sends a warning message to the portable electronic device, using the computer network, that is displayed on the touchscreen of the portable electronic device when the auxiliary unit receives the alert from the base unit.

2. A child safety boundary alarm, for protecting a child, comprising:

a dwelling having an interior space, a computer network, an outside wall having a door, an exterior space including a ground surface and a hazard;

a base unit, having a housing mounted on the exterior wall near the door, the housing having a sensitivity control and a pair of sensor wire inputs and having an alarm annunciator for generating a loud audible warning and also creates a highly visible flashing light warning, the base unit also having a wireless transmitter;

a sensor wire extending along the ground surface between the hazard and the exterior wall, the sensor wire connected to the sensor wire inputs on the base unit and creating a closed loop between the sensor wire inputs;

a bracelet, adapted to be worn by a child, the bracelet having a sensor transceiver and a local transmitter so that when the bracelet travels over the sensor wire an alert condition is detected by the sensor transceiver, transmitted to the base unit by the local transmitter, and an alert signal is generated by the base unit, and the loud audible warning is generated by the alarm annunciator, wherein the sensitivity control on the base unit adjusts responsiveness of the base unit to proximity of the sensor wire to the bracelet; and an auxiliary unit located within the interior space of the dwelling, connected to the computer network, when the alert is generated by the base unit the alert signal is transmitted by the wireless transmitter to the auxiliary unit and an audible alarm is provided by the auxiliary unit; and a portable electronic device, having a touchscreen and connected to the computer network, wherein the auxiliary unit sends a warning message to the portable electronic device, using the computer network, that is displayed on the touchscreen of the portable electronic device when the auxiliary unit receives the alert from the base unit.

3. The child safety boundary alarm as recited in claim 2, wherein the hazard has an outer edge, and wherein the sensor wire extends fully around the hazard at a margin distance from the outer edge.

* * * * *